United States Patent [19]

Akiyama et al.

[11] Patent Number: 4,638,542

[45] Date of Patent: Jan. 27, 1987

[54] METHOD AND APPARATUS FOR FORMING ELEMENT-FREE SPACES IN SLIDE FASTENER CHAINS

[75] Inventors: Hideki Akiyama, Toyama; Shigeru Imai, Namerikawa, both of Japan

[73] Assignee: Yoshida Kogyo K. K., Tokyo, Japan

[21] Appl. No.: 623,116

[22] Filed: Jun. 22, 1984

[30] Foreign Application Priority Data

Jun. 28, 1983 [JP] Japan ..... 58-116300
Jul. 2, 1983 [JP] Japan ..... 58-103089[U]

[51] Int. Cl.[4] ..... B23P 11/00

[52] U.S. Cl. ..... 29/408; 29/33.2; 29/770; 83/921

[58] Field of Search ..... 29/33.2, 408, 770, 410; 83/921, 684, 30, 32, 13

[56] References Cited

U.S. PATENT DOCUMENTS

| | | | |
|---|---|---|---|
| 3,128,543 | 4/1964 | Fasciano | 83/921 |
| 3,456,328 | 7/1969 | Wasko | 29/408 |
| 3,490,133 | 1/1970 | Gleirdmeyer et al. | 83/921 |
| 3,763,546 | 10/1973 | Perlman | 29/33.2 |
| 3,812,754 | 5/1974 | Kawakami | 29/408 |
| 3,852,869 | 12/1974 | Shimai | 29/408 |
| 3,863,323 | 2/1975 | Takamatsu | 29/408 |
| 4,131,223 | 12/1978 | Aureli | 83/921 |
| 4,404,722 | 9/1983 | Shimai | 29/33.2 |

FOREIGN PATENT DOCUMENTS

| | | |
|---|---|---|
| 45297 | 1/1970 | Japan . |
| 56-156104 | 12/1981 | Japan . |

*Primary Examiner*—Donald R. Schran
*Assistant Examiner*—James L. Wolfe
*Attorney, Agent, or Firm*—Hill, Van Santen, Steadman & Simpson

[57] ABSTRACT

A punch blade depresses the coupling heads of a length of successive filamentary coupling elements toward a knockout blade while sandwiching stringer tapes between upper and lower grippers. The punch blade is lowered until lower legs of the coupling elements are cut off by cutter blades. The punch blade and the knockout blade are then lifted while gripping the severed coupling elements therebetween to forcibly remove the coupling elements out of engagement with sewing threads on the stringer tapes. The upper grippers have confronting steps for engaging the sewing threads so that the severed coupling elements can be detached reliably and smoothly from the stringer tapes without unduly tensioning the sewing threads and stringer tapes. The punch blade may have a vertical reinforcement member attached to at least one side edge thereof and having a lower tooth projecting downwardly beyond a lower edge for being pressed against the coupling elements. The lower tooth enters between adjacent coupling elements to position the coupling elements against unwanted longitudinal displacement with respect to the punch blade.

10 Claims, 18 Drawing Figures

METHOD AND APPARATUS FOR FORMING ELEMENT-FREE SPACES IN SLIDE FASTENER CHAINS

BACKGROUND OF THE INVENTION

1. Field of the Invention

The present invention relates to the formation of element-free spaces or gaps in slide fastener chains having intermeshing rows of continuous filamentary coupling elements sewn to confronting longitudinal edges of slide fastener stringer tapes.

2. Description of the Prior Art

There is known an apparatus for gapping a slide fastener chain by cutting interdigitating rows of helically coiled coupling elements over a length and pushing upwardly the severed coupling elements off their stringer tapes to thereby form an element-free space or gap equal to the length (Japanese Laid-Open Patent Publication No. 56-156104 published on Dec. 2, 1981). More specifically, the disclosed apparatus has upper and lower grippers for gripping the stringer tapes and a cutter blade movable toward a lower die for thrusting into the length of intermeshing coupling elements placed against the lower die to cut off upper legs of the coupling elements above coupling heads thereof. After the desired upper legs of the coupling elements have been cut off, a knockout blade is moved upwardly between the stringer tapes across the horizontal plane thereof to forcibly remove the severed coupling elements off sewing stitches on the stringer tapes.

The above conventional gapping apparatus has the following disadvantages: Since the upper legs of desired coupling elements are severed by the cutter blade having a single cutting edge, the cut edges of the coupling elements are relatively remote from the sewing stitches by which the coupling elements are fastened to the stringer tapes. Additionally, the severed coupling elements are moved merely upwardly by the knockout blade until they are freed from the stringer tapes. Under such conditions, a large force has to be imposed by the knockout blade on the cut-off coupling elements to remove them from the stringer tapes, with the result that the sewing stitches and/or the stringer tapes are likely to be torn apart or otherwise damaged under undue forces.

Another chain gapping apparatus is disclosed in Japanese Patent Publication No. 45-297 published on Jan. 8, 1970. The chain gapping apparatus also has upper and lower grippers for gripping stringer tapes and a flat punch movable toward cutter blades for pressing a length of intermeshing coupling elements against the cutter blades to cut off lower legs of the coupling elements below coupling heads thereof. In the gapping apparatus of the disclosed type, the punch has a flat or arcuate lower end surface for contacting the coupling elements. When the punch presses the length of coupling elements against the cutter blades, the coupling elements are apt to slip longitudinally against the flat lower surface of the punch, thus failing to position the slide fastener chain with respect to the punch in forming a gap or space in the slide fastener chain. The punch causes another problem at the time of removing the severed coupling elements off the stringer tapes by depressing the punch and the cutter blades with the severed coupling elements sandwiched therebetween. During the downward movement of the punch and the cutter blades, the severed coupling elements are likely to move longitudinally with respect to the punch and the cutter blades. As a result, some severed coupling elements at an end of the gap to be formed are displaced out of engagement with the punch and the cutter blades and will remain unremoved on the stringer tapes.

SUMMARY OF THE INVENTION

According to the present invention, the coupling heads of certain successive coupling elements on a slide fastener chain are depressed by a punch blade toward a knockout blade while sandwiching stringer tapes between upper and lower grippers. The punch blade is lowered until lower legs of the coupling elements are cut off by cutter blades adjacent to the knockout blade. The punch blade and the knockout blade are then lifted while gripping the severed coupling elements therebetween to forcibly remove the coupling elements out of engagement with sewing threads on the stringer tapes. While thus removing the severed coupling elements, the sewing threads are engaged by steps on the upper grippers so that the severed coupling elements can be detached reliably and smoothly from the stringer tapes without unduly tensioning the sewing threads and stringer tapes. The punch blade may have a vertical reinforcement member attached to at least one side edge thereof and having a lower tooth projecting downwardly from a lower edge of the punch blade. When the punch blade is pressed against the coupling elements, the lower tooth enters adjacent coupling elements to position the coupling elements against unwanted longitudinal displacement with respect to the punch blade.

It is an object of the present invention to provide an apparatus for forming an element-free space in a slide fastener chain by removing severed coupling elements easily and smoothly from stringer tapes without breaking or damaging sewing threads and/or stringer tapes.

Still another object of the present invention is to provide a method of forming an element-free space in a slide fastener chain by removing severed coupling elements easily and smoothly from stringer tapes without breaking or damaging sewing threads and/or stringer tapes.

Another object of the present invention is to provide a punch blade for use in an apparatus for forming an element-free space in a slide fastener chain, the punch blade being capable of easily and accurately positioning successive coupling elements on the chain for removal from stringer tapes and of removing the severed coupling elements from the stringer tapes without fail.

Many other advantages and features of the present invention will become manifest to those versed in the art upon making reference to the detailed decription and the accompanying sheets of drawings in which preferred structural embodiments incorporating the principles of the present invention are shown by way of illustrative example.

DESCRIPTION OF THE PREFERRED EMBODIMENTS

Figure 1:
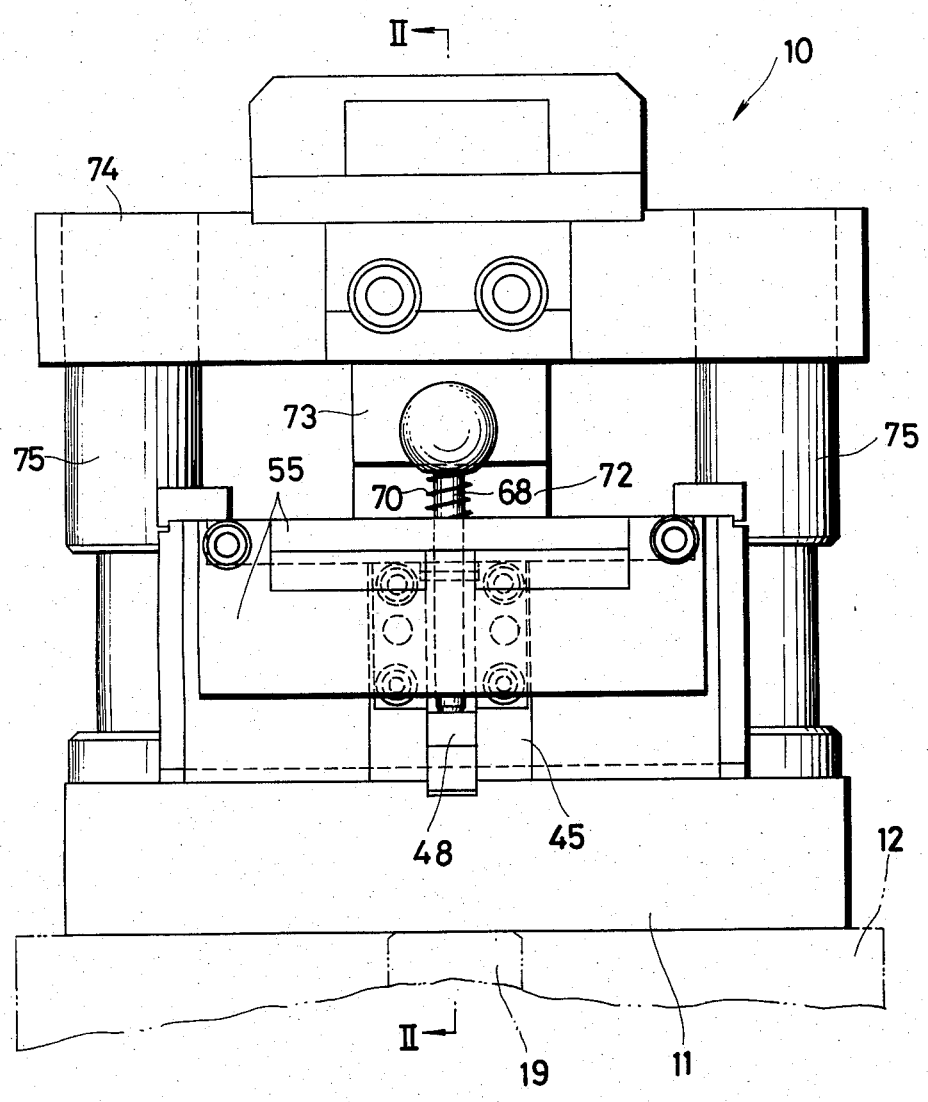
FIG. 1 is a front elevational view of an apparatus for forming an element-free gap or space in a slide fastener chain according to the present invention.

Like or identical reference numerals denote like or identical parts throughout the views.

Figure 2:
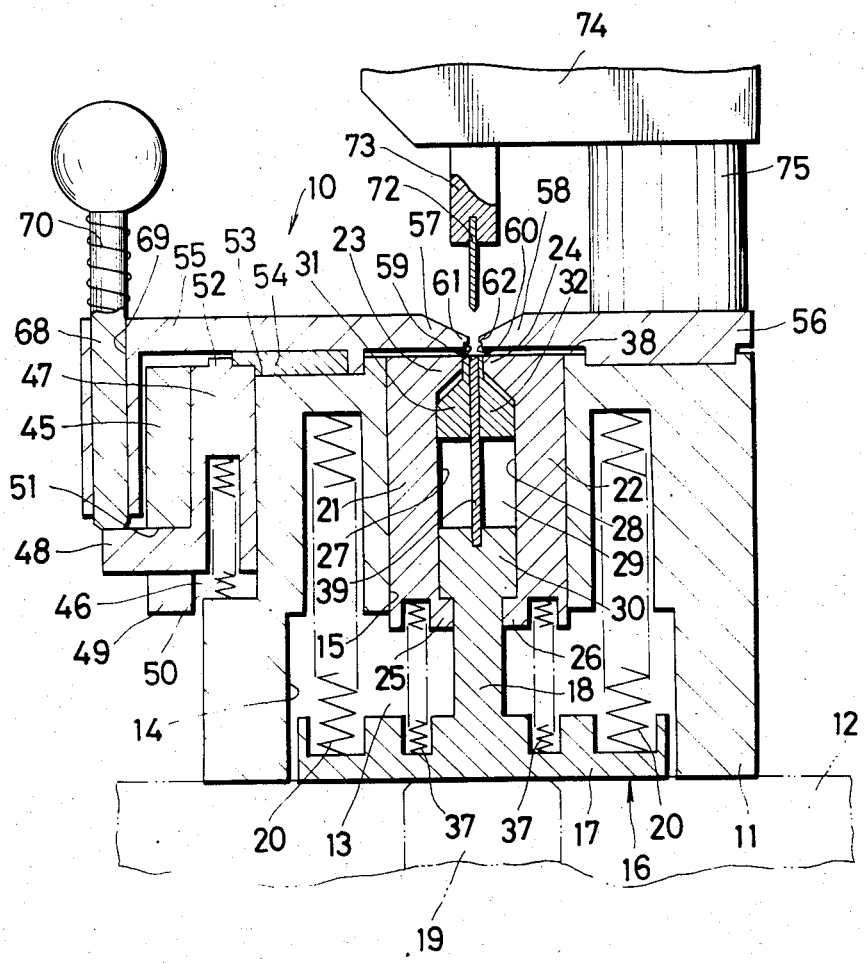
FIG. 2 is a cross-sectional view taken along line II—II of FIG. 1.

FIGS. 1 and 2 illustrate an apparatus for forming a space or gap devoid of coupling elements in a continuous slide fastener chain composed of intermeshing filamentary coupling elements according to the present invention. The apparatus, generally designated at 10, comprises a frame 11 mounted on a base 12 and having a central cavity 13 (FIG. 2) opening upwardly and downwardly. The cavity 13 extends longitudinally of the frame 11 or the direction, normal to the sheet of FIG. 2, in which a slide fastener chain to be gapped is fed along. The cavity 13 has a lower wider portion 14 and an upper narrower portion 15 communicating therewith.

A movable support 16 of a substantially inverted T-shaped cross section is vertically movably disposed in the cavity 13, the movable support 16 extending longitudinally in and along the cavity 13. The movable support 16 includes a horizontal base 17 located in the lower wider portion 14 of the cavity 13 and a vertical leg 18 extending upwardly from a central portion of the horizontal base 17 into the upper narrower portion 15 of the cavity 13. The horizontal base 17 is connected to a plunger 19 mounted in the base 12 and actuatable to move the movable support 16 upwardly in the cavity 13 as described later on.

The cavity 13 accommodates therein a plurality of compression coil springs 20 acting between the frame 11 and the horizontal base 17 of the movable support 16 for normally urging the movable support 16 against the base 12. When the plunger 19 is actuated, the movable support 16 is moved upwardly in the cavity 13 against the resilient forces of the compression coil springs 20.

A pair of lower grippers 21, 22 is vertically movably disposed in the upper narrower portion 15 of the cavity 13 and spaced from each other transversely of the slide fastener chain to be gapped. The lower grippers 21, 22 have shapes which are the mirror images of each other, and include upper gripping jaws 23, 24 and lower locking arms 25, 26, which project toward each other and are vertically spaced by central recesses 27, 28 defined in confronting side surfaces of the lower grippers 21, 22. The lower grippers 21, 22 (and hence the gripping jaws 23, 24, the recesses 27, 28, and the locking arms 25, 26 thereof) extend longitudinally in and along the upper narrower portion 15 of the cavity 13.

The recesses 27, 28 in the lower grippers 21, 22 jointly constitute a space 29 in which there is fitted an upper enlarged head 30 of the vertical leg 18 of the movable support 16, the head 30 being engageable by the locking arms 25, 26. A pair of transversely spaced fixed cutter blades 31, 32 is also fitted in the space 29 in vertically spaced relation to the head 30, the cutter blades 31, 32 extending longitudinally along the lower grippers 21, 22. The cutter blades 31, 32 have longitudinal ends (not shown) fixed to the frame 11. As better shown in FIGS. 3A through 3F, the cutter blades 31, 32 have upper cutter edges 33, 34, respectively, slanting downwardly away from each other and interposed transversely between the gripping jaws 23, 24 (FIG. 2). The cutting edges 33, 34 have sharp uppermost ends located normally downwardly of upper surfaces 35, 36 (FIG. 3A) of the lower grippers 21, 22.

The lower grippers 21, 22 are normally biased upwardly to keep the locking arms 25, 26 (FIG. 2) in engagement with the head 30 under the resilient forces of a plurality of compression coil springs 37 disposed in the cavity 13 and acting between the lower grippers 21, 22 and the horizontal base 17 of the movable support 16. The lower grippers 21, 22 are fixed together at their longitudinal ends (not shown). The upper surfaces 35, 36 of the lower grippers 21, 22 are normally held lying flush with an upper guide surface 38 of the frame 11 which guides a slide fastener chain thereon. When the plunger 19 is actuated, the upper surfaces 35, 36 of the lower grippers 21, 22 are moved upwardly beyond the guide surface 38 through the movable support 17 and the compression coil springs 37.

A longitudinally elongate vertical knockout blade 39 is disposed vertically movably between the fixed cutter blades 31, 32 and has a lower end embedded in the head 30 of the vertical leg 18 of the movable support 16. The knockout blade 39 has its upper portion normally retracted between the fixed cutter blades 31, 32. When the plunger 19 is actuated, the upper portion of the knockout blade 39 projects upwardly from and between the cutter blades 31, 32. The knockout blade 39 has in its upper edge a longitudinal groove 40 (FIGS. 3A through 3F) of a V-shaped cross section.

The upper surfaces 35, 36 of the lower grippers 21, 22 have a plurality of longitudinal ridges 41, 42 which are transversely spaced and project upwardly for biting engagement with slide fastener stringer tapes 43, 44 as shown in FIGS. 3B through 3F.

As illustrated in FIG. 2, a plate member 45 is attached to one lateral side of the frame 11 with a space 46 defined therebetween, in which a stop 47 is vertically movably positioned. The stop 47 has a horizontally projecting lower end 48 extending through a downwardly opening recess 49 defined in a lower end of the plate member 45. The stop 47 is normally urged upwardly by a compression coil spring 50 acting between the stop 47 and the frame 11 until the horizonatlly projecting lower end 48 engages an upper end 51 of the recess 49 and an upper end 52 of the stop 47 projects upwardly beyond an upper surface 53 of the frame 11.

A pair of upper grippers 55, 56 is mounted on the upper surface of the frame 11 in transversely spaced relation. The upper grippers 55, 56 have a pair of contronting gripping jaws 57, 58, respectively, having guide recesses 59, 60, (FIG. 3A) respectively, with their upper edges defined by engaging steps 61, 62, respectively, projecting toward each other.

The gripping jaws 57, 58 have lower surfaces 63, 64, respectively, spaced slightly from the upper surfaces 35, 36, respectively, of the lower grippers 21, 22 in confronting relation. The lower surfaces 63, 64 have a plurality of longitudinal ridges 65, 66, respectively, for biting engagement with the stringer tapes 43, 44.

The upper gripper 55 is transversely retractable away from the upper gripper 56, but is normally held in an advanced position by the stop 47 and a spacer 54 disposed between the upper gripper 55 and the upper surface 53 of the frame 11. A vertical rod-shaped handle 68 is vertically movably mounted on the upper gripper 55 remotely from the gripping jaw 57, the handle 68 having a lower end held against the horizontally projecting lower end 48 of the stop 47. The handle 68 is normally urged by a spring 70 to move in an upward direction. The upper gripper 55 can be retracted away from the upper gripper 56 when the handle 68 is depressed against the force of the spring 70 to move the stop 47 downwardly for retracting the upper end 52 thereof out of the way of the spacer 54.

Figure 3A:
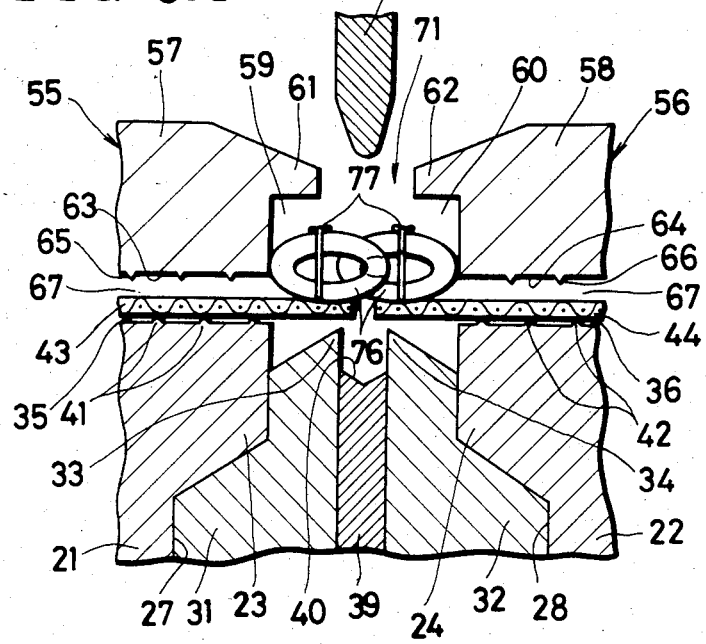
FIGS. 3A through 3F are fragmentary transverse cross-sectional views showing progressive steps of forming an element-free space in a slide fastener chain in the apparatus of FIG. 1.

As shown in FIG. 3A, there is a guide space 67 for guiding the stringer tapes 43, 44 between the upper surfaces 35, 36 of the lower grippers 21, 22 and the lower surfaces 63, 64 of the upper grippers 55, 56 adjacent to the gripping jaws 23, 24 and 57, 58.

A punch blade 72 having a rounded lower end is disposed above the upper grippers 55, 56 in vertical alignment with the knockout blade 39. The punch blade 72 is substantially coextensive longitudinally with the knockout blade 39. The punch blade 72 is supported on a blade mount 73 fixed to a vertically movable body 74 which is supported and vertically moved by drive mechanisms 75, 75 such as plungers or pneumatic cylinders.

Operation of the apparatus thus constructed is described with reference to FIGS. 3A through 3F.

An elongate slide fastener chain 71 to be gapped by the apparatus is composed of the stringer tapes 43, 44 supporting on and along confronting longitudinal edges thereof a pair of intermeshing filamentary coupling elements 76 such for example as helically coiled coupling elements sewn by sewing threads 77 to the stringer tapes 43, 44. For setting the elongate slide fastener chain 71 in the apparatus, the upper gripper 55 is transversely retracted away from the upper gripper 56, and one of the stringer tapes 44 is inserted into the space 67 between the upper and lower grippers 56, 22 while the other stringer tape 43 is placed on the upper surface 35 of the lower gripper 21. At this time, the intermeshing row of coupling elements 76 faces the punch blade 72 in vertical alignment therewith. Then, the upper gripper 55 is advanced toward the upper gripper 56 so that the intermeshing row of coupling elements 76 is positioned in the guide recesses 59, 60, as illustrated in FIG. 3A. The upper gripper 55 is now locked in the advanced position by the stop 47 as shown in FIG. 2.

Figure 3B:
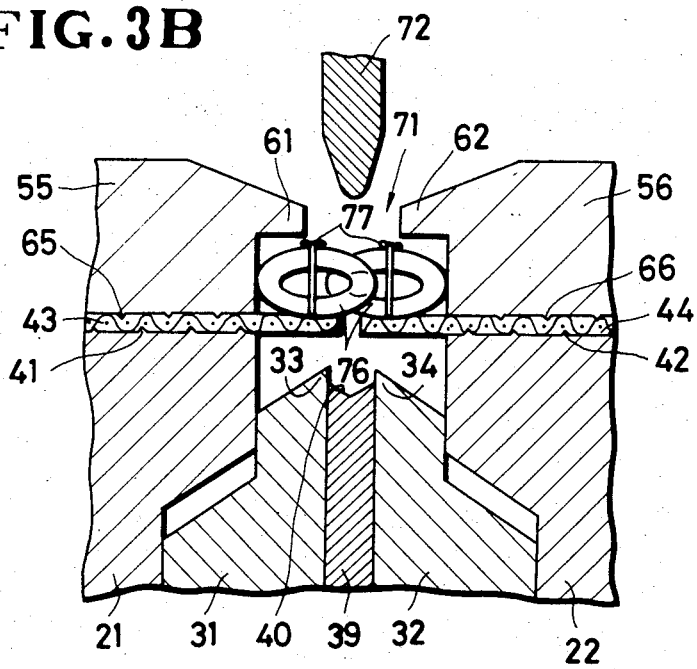

For forming an element-free space in the slide fastener chain 71, the plunger 19 is actuated to lift the lower grippers 21, 22 until the stringer tapes 43, 44 are firmly gripped between the lower and upper grippers 21, 22 and 55, 56, as shown in FIG. 3B. At this time, the ridges 41, 42 on the lower grippers 21, 22 and the ridges 65, 66 on the upper grippers 55, 56 bite into the stringer tapes 43, 44, whereby the stringer tapes 43, 44 are securely held in position against transverse displacement during subsequent space formation. When the slide fastener chain 71 is lifted by the lower grippers 21, 22 as illustrated in FIG. 3B, it is spaced vertically from the cutter edges 33, 34 by a distance greater than the distance between the slide fastener chain 71 and the cutter edges 33, 34 as shown in FIG. 3A.

Figure 3C:
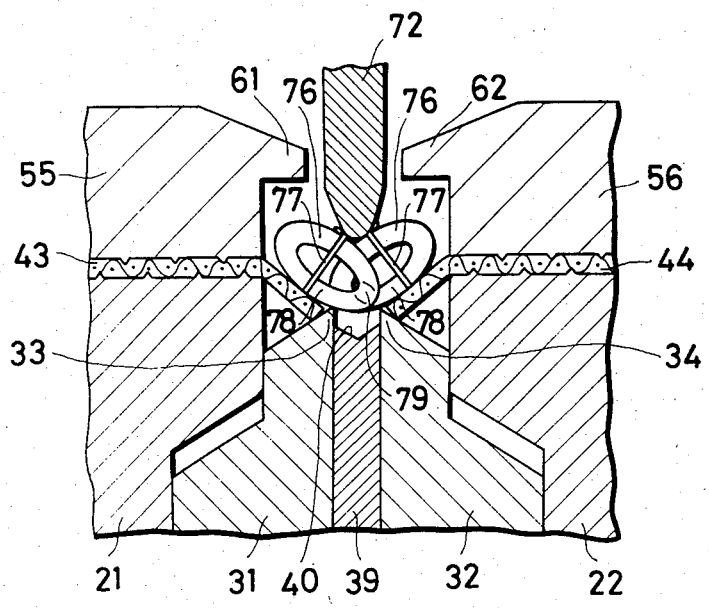
Figure 3D:
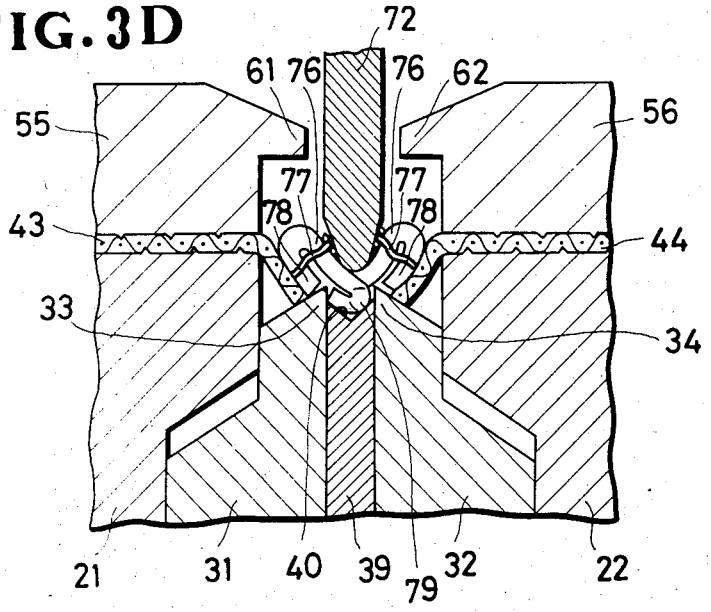

Then, the drive mechanisms 75 are actuated in one direction to lower the punch blade 72. The lower end of the punch blade 72 depresses coupling heads 79 of the coupling elements 76 to expose the coupling heads 79 to the cutter edges 33, 34 as shown in FIG. 3C. The confronting inner longitudinal edges of the stringer tapes 43, 44 are now positioned clear of the tip ends of the cutter edges 33, 34. The punch blade 72 is continuously depressed to push lower legs 78 of certain successive coupling elements 77 against the cutter edges 33, 34 thereby cutting off the lower legs 78 as shown in FIG. 3D. The coupling heads 79 are now received in the groove 40 between the cutter edges 33, 34. Since the confronting inner longitudinal edges of the stringer tapes 43, 44 are positioned out of the way of the cutter edges 33, 34, the stringer tapes 43, 44 are displaced transversely away from each other while the lower legs 78 of the coupling elements 77 are being severed. Therefore, the stringer tapes 43, 44 and the sewing threads 77 will not be cut off by the cutter edges 33, 34.

Figure 3E:
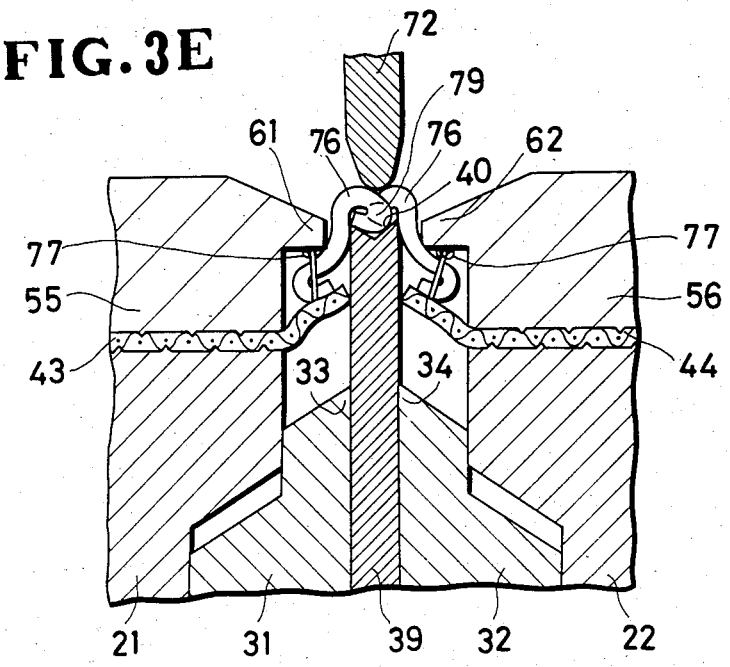
Figure 3F:
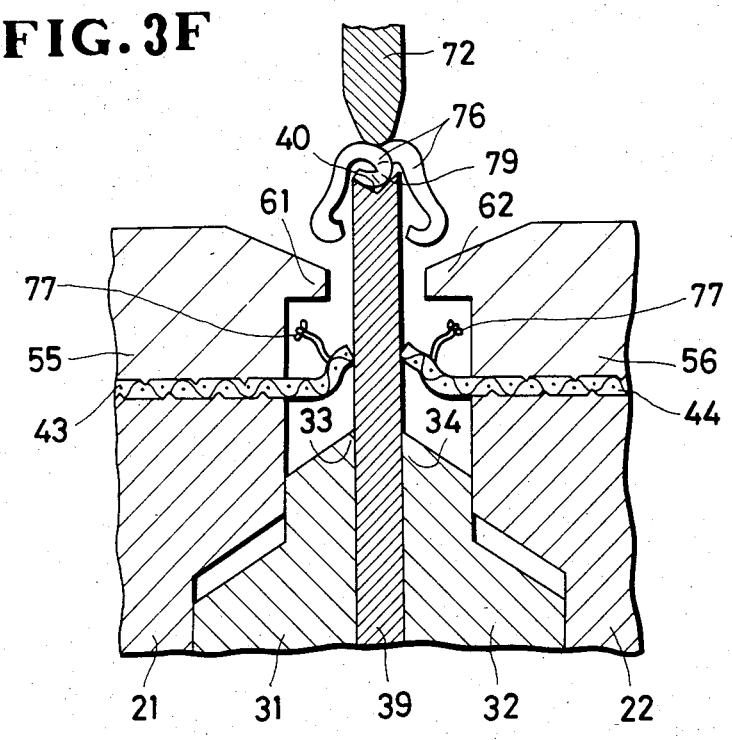

After the lower legs 78 of the coupling elements 76 have been cut off, the plunger 19 is actuated again to lift the knockout blade 39 and the drive mechanisms 75 are operated in an opposite direction to retract the punch blade 72 upwardly. The severed coupling elements 76 are then forcibly moved upwardly with the coupling heads 79 clamped between the knockout blade 39 and the punch blade 72 as shown in FIG. 3E. Continued upward movement of the knockout blade 72 and the punch blade 39 causes the severed coupling elements 76 to be disengaged from the sewing threads 77 on the stringer tapes 43, 44 as shown in FIG. 3F. Since the lower legs 78 of the coupling elements 76 have been cut off, the severed coupling elements 76 as they are raised can easily be removed out of engagement with the sewing threads 77 with a relatively small force. While the coupling elements 76 are forcibly moved upwardly, the sewing threads 77 are brought into engagement with the steps 61, 62 of the upper grippers 55, 56 as illustrated in FIG. 3E. The sewing threads 77 are therefore prevented by the steps 61, 62 from being pulled upwardly with the coupling elements 76. This allows the coupling elements 76 to be reliably and smoothly pulled out of engagement with the sewing threads 77. In addition, the sewing threads 77 and the stringer tapes 43, 44 are protected by the steps 61, 62 from being subjected to undue transverse tension and hence from being broken or otherwise damaged.

After the cut-off coupling elements 76 have been removed from the stringer tapes 43, 44, the plunger 19 is actuated to lower the knockout blade 39 and the lower grippers 21, 22 to the position shown in FIG. 3A. Then, the slide fastener chain 71 is longitudinally fed along for a desired interval and stopped to define a next following element-free space in the manner described above.

Figure 4:
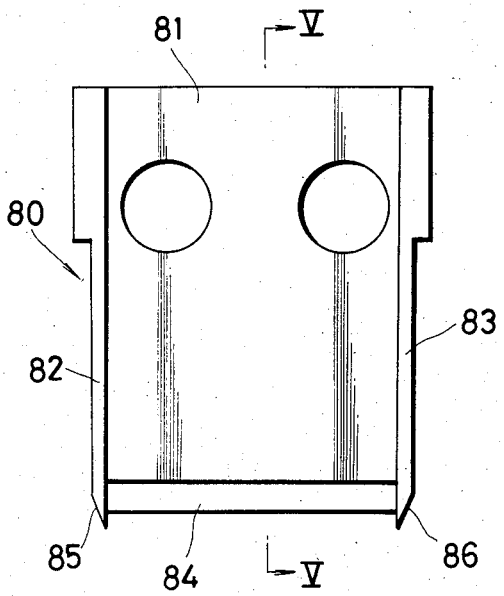
FIG. 4 is a front elevational view of a punch according to another embodiment of the present invention.
Figure 5:
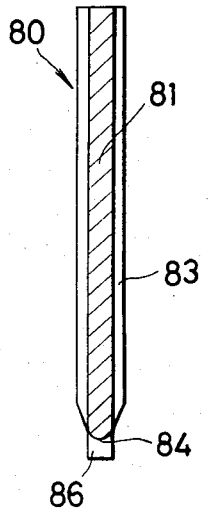
FIG. 5 is a cross-sectional view taken along line V—V of FIG. 4.

FIGS. 4 and 5 illustrate a punch blade 80 constructed in accordance with another embodiment of the present invention. The punch blade 80 comprises a plate-shaped body 81 and a pair of vertical reinforcement members 82, 83 attached to and extending along opposite side edges, respectively, of the body 81. The body 81 has a lower rounded edge 84 serving as a coupling element presser. The vertical reinforcement members 82, 83 have a width larger than the thickness of the body 81 and include lower pointed teeth 85, 86, respectively, projecting downwardly beyond the lower edge 84 of the body 81.

Figure 6A:
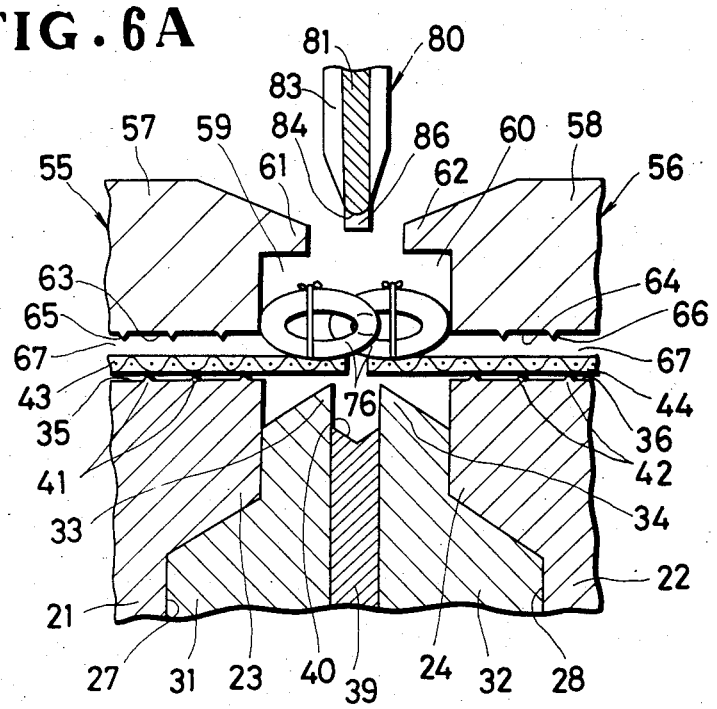
FIGS. 6A through 6E are fragmentary transverse cross-sectional views showing successive steps of forming an element-free space in a slide fastener chain in an apparatus using the punch of FIG. 4.
Figure 6B:
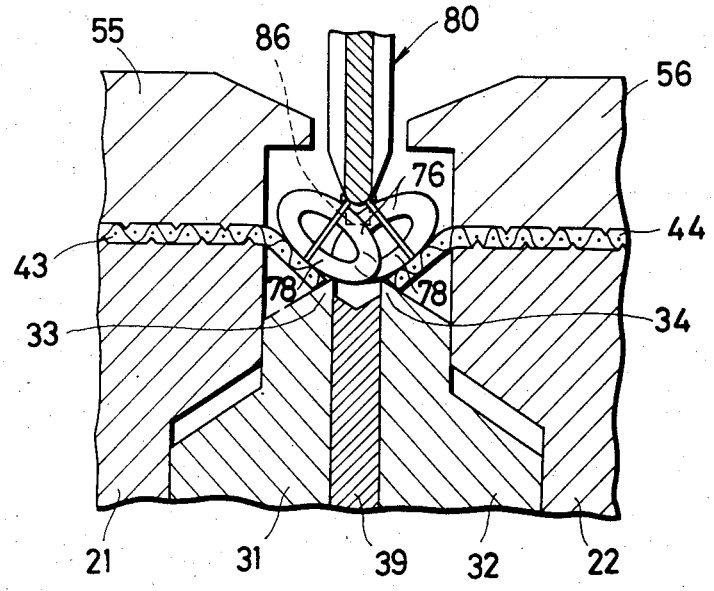
Figure 6C:
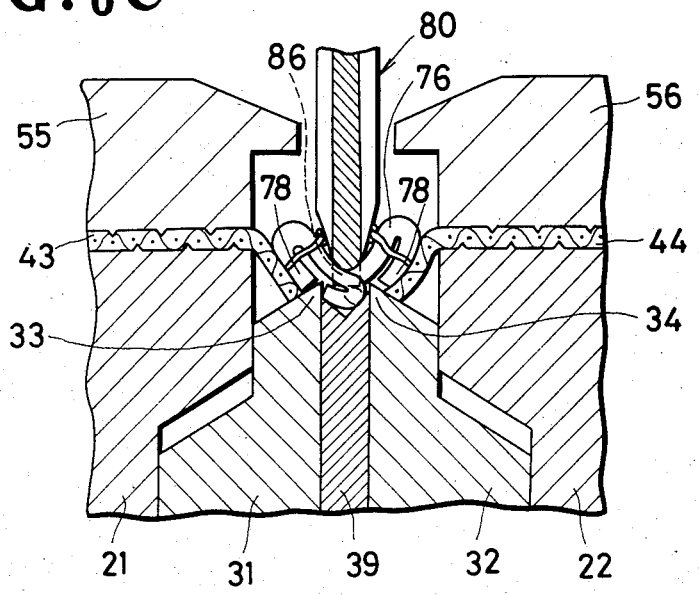
Figure 6D:
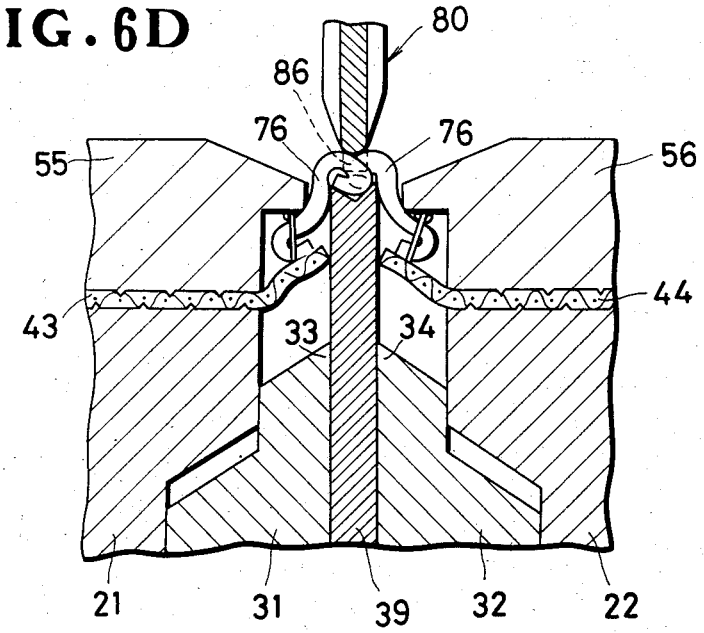
Figure 6E:
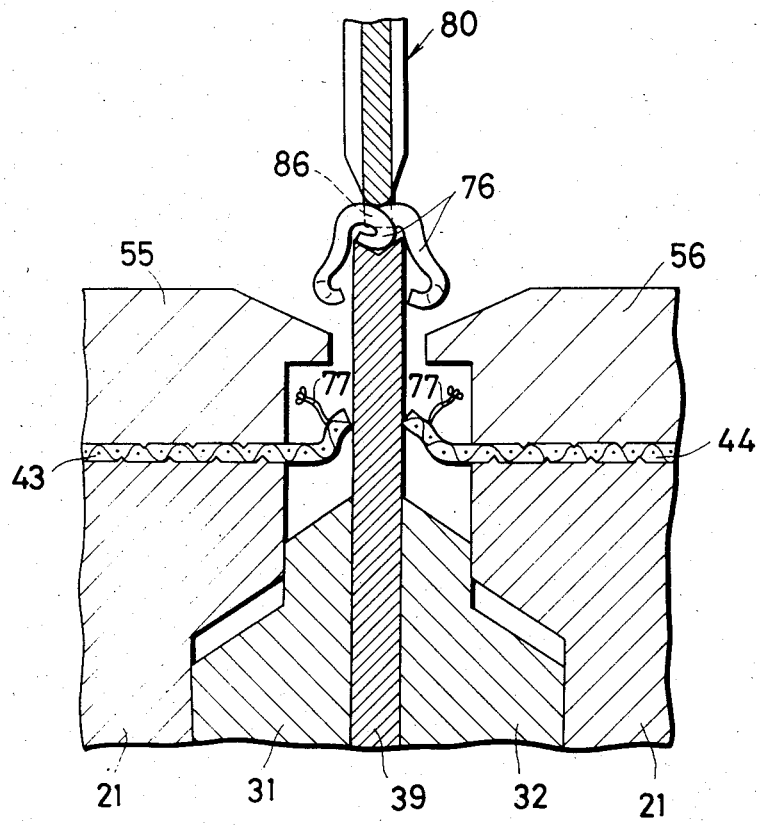
Figure 7A:
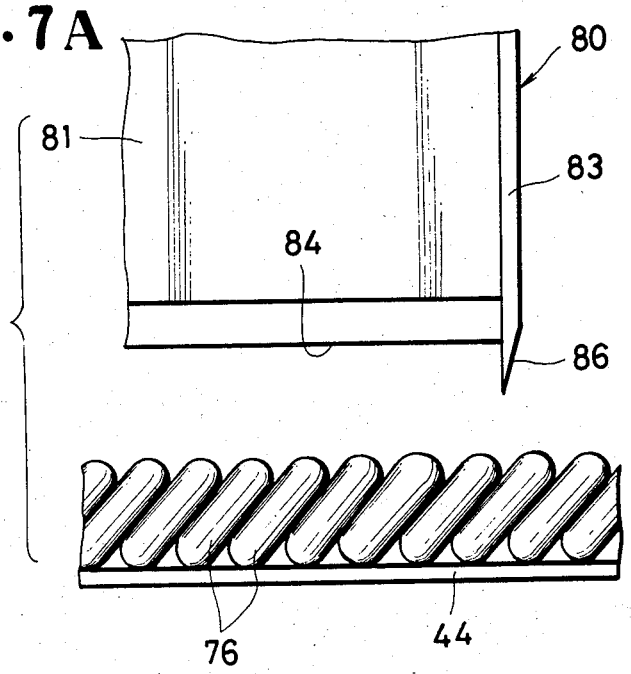
FIGS. 7A and 7B are fragmentary side elevational views illustrative of the manner in which the punch of FIG. 4 operates.
Figure 7B:
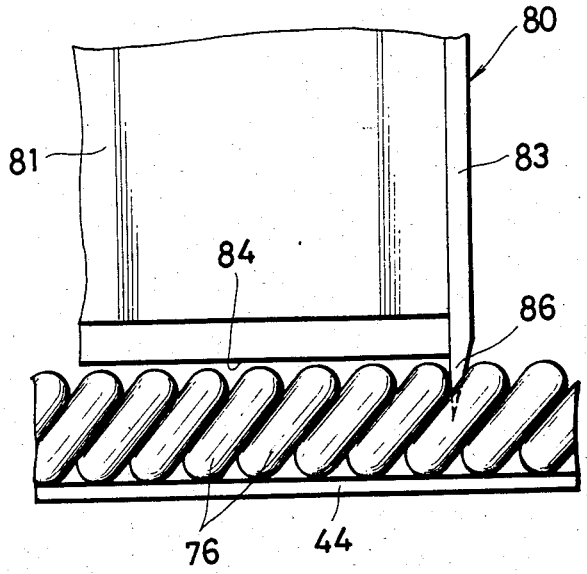

The punch blade 80 will operate in substantially the same manner as the punch blade 72 of the previous embodiment. However, as shown in FIGS. 6A through 6E and 7A and 7B, the lower pointed teeth 86 (only one shown) enter between adjacent coupling elements 76 slightly before and while the lower edge 84 of the punch blade 80 is held against the coupling elements 76. Therefore, the coupling elements 76 are prevented by the teeth 85, 86 from being longitudinally displaced with respect to the punch blade 81, as best shown in FIG. 7B. Since the helically coiled coupling elements 76 have round outer surfaces, the teeth 85, 86 will smoothly be guided by the round outer surfaces to slip into poisiton between the adjacent coupling elements 76 even if the teeth 85, 86 hit the coupling elements 76. When the severed coupling elements 76 are disengaged from the sewing threads 77, the teeth 85, 86 remain positioned between the adjacent coupling elements 76. Therefore, the severed coupling elements 76 as they are being removed are still prevented from being longitudinally displaced with respect to the punch blade 80, and can reliably be detached from the stringer tapes 43, 44 without fail as shown in FIG. 6E.

Figure 8:
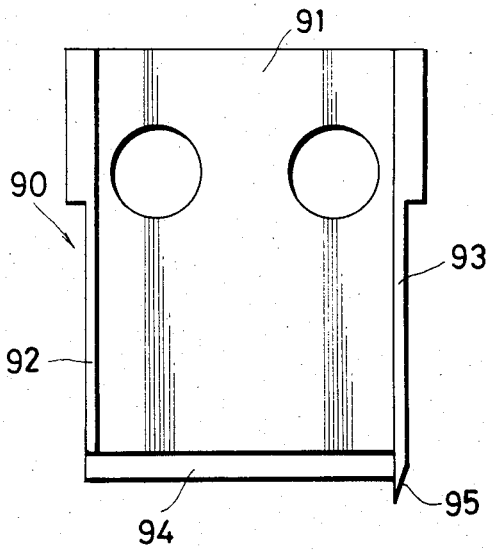
FIG. 8, appearing with FIGS. 4 and 5, is a front elevational view of a punch according to still another embodiment of the present invention.

FIG. 8 illustrates a punch blade 90 according to still another embodiment of the present invention. The punch blade 90 includes a plate-shaped body 91 with vertical reinforcement members 92, 93 attached to opposite side edges thereof, one of the vertical reinforcement members 93 having a lower pointed tooth 95 projecting downwardly beyond a lower rounded edge 94 of the body 91.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. A method of forming an element-free space in a slide fastener chain composed of a pair of stringer tapes supporting an intermeshing row of coupling elements secured to confronting longitudinal edges of the stringer tapes by sewing threads and having coupling heads and lower legs disposed on the upper sides of the respective stringer tapes, comprising the steps of:

(a) gripping the stringer tapes by upper grippers and lower grippers with the coupling elements spaced vertically and directed away from a pair of spaced fixed cutter blades;

(b) lowering the upwardly facing coupling heads with a punch blade acting thereon to tilt the coupling elements and the marginal edges of the stringer tapes downwardly towards the spaced fixed cutter blades for thereby angularly spreading the confronting tape edges such that the spaced fixed cutter blades pass between the spread confronting tape edges and then engage the lower tape-engaging legs of the coupling elements at positions which are disposed close to the confronting tape edges;

(c) continuously depressing the coupling heads further to push the lower legs against the spaced fixed cutter blades, thereby cutting off the lower tape-engaging legs of the coupling elements on the fixed cutter blades;

(d) lifting the severed coupling elements away from said fixed cutter blades while they are being clamped between the punch blade and a knockout blade vertically aligned therewith until the severed coupling elements pulled out of engagement with the sewing threads; and (e) holding the sewing threads in engagement with overlying portions of the upper grippers during the pulling portion of said lifting step (d).

2. A method according to claim 1, further including the step of further angularly spreading the stringer tapes away from each other during said cutting step (c).

3. A method according to claim 1, further including the step of holding the coupling elements with the punch blade against longitudinal displacement with respect to the punch blade during said cutting and lifting steps (c) and (d).

4. An apparatus for forming an element-free space in a slide fastener chain composed of a pair of stringer tapes supporting an intermeshing row of coupling elements secured to confronting longitudinal edges of the stringer tapes by sewing threads and having coupling heads and lower legs disposed on the upper sides of the respective stringer tapes, said apparatus comprising:

(a) a pair of lower grippers transversely spaced from each other;

(b) a pair of upper grippers transversely spaced from each other and positioned above said lower grippers said lower grippers being vertically movable toward said upper grippers for gripping therewith the stringer tapes therebetween with the coupling elements facing upwardly;

(c) a pair of fixed cutter blades disposed between said lower grippers and having a pair of upper cutter edges, respectively, said cutter edges being normally spaced vertically from the gripped stringer tapes and the coupling elements;

(d) a knockout blade disposed between said fixed cutter blades and vertically movable between said lower grippers and said upper grippers;

(e) a punch blade disposed upwardly of and in vertical alignment with said knockout blade and movable toward said knockout blade for directly acting against the coupling heads of the coupling elements, first to angularly tilt the coupling elements and the longitudinal edges of the stringer tapes downwardly toward said cutter edges such that the spaced fixed cutter blades pass between the confronting tape edges and then engage the lower tape-engaging legs of the coupling elements at positions which are disposed close to confronting tape edges and then to cut off the lower tape-engaging legs on said cutter edges, said punch blade and said knockout blade being movable upwardly away from said cutter blades with the severed coupling elements clamped therebetween; and (f) said upper grippers having overlying portions for engaging the sewing threads while the severed coupling elements are being lifted by said punch blade and said knockout blade.

5. An apparatus according to claim 4, said overlying portion comprising a pair of confronting steps projecting toward each other.

6. An apparatus according to claim 4, said punch blade comprising a body having a lower rounded edge and a pair of reinforcement members attached to opposite longitudinally spaced side edges of said body and having a pair of teeth spaced by the prospective element-free space projecting downwardly beyond said lower rounded edge for entering between adjacent coupling elements when said lower rounded edge is held against the coupling elements.

7. An apparatus according to claim 4, said punch blade comprising a body having a lower rounded edge and a pair of reinforcement members attached to opposite longitudinally spaced side edges of said body, one of said reinforcement members having a tooth disposed at an end of the prospective element-free space projecting downwardly beyond said lower rounded edge for entering between adjacent coupling elements when said lower rounded edge is held against the coupling elements.

8. A punch blade for pressing a length of successive filamentary coupling elements against cutter edges of cutter blades to cut off lower legs of the coupling elements, said punch blade comprising a body having a lower rounded edge and a pair of reinforcement members attached to opposite longitudinally spaced side edges of said body, at least one of said reinforcement members having a tooth disposed at an end of said length of coupling elements and projecting downwardly beyond said lower rounded edge for entering between adjacent coupling elements when said lower rounded edge is held against the coupling elements.

9. A punch blade according to claim 8, said reinforcement members having a pair of said teeth, respectively.

10. A punch blade according to claim 8, only one of said reinforcement members having said tooth.

* * * * *